US006270165B1

(12) United States Patent
Peay

(10) Patent No.: US 6,270,165 B1
(45) Date of Patent: Aug. 7, 2001

(54) CUTTING TOOL FOR BREAKING HARD MATERIAL, AND A CUTTING CAP THEREFOR

(75) Inventor: Kent Peay, Bristol, TN (US)

(73) Assignee: Sandvik Rock Tools, Inc., Bristol, VA (US)

( * ) Notice: Subject to any disclaimer, the term of this patent is extended or adjusted under 35 U.S.C. 154(b) by 0 days.

(21) Appl. No.: 09/425,217

(22) Filed: Oct. 22, 1999

(51) Int. Cl.[7] ..... E21C 35/183
(52) U.S. Cl. ..... 299/111
(58) Field of Search ..... 299/111, 113, 299/110, 79.1, 85.2, 87.1, 100, 102, 103, 104, 105, 106, 107, 108, 109; 175/426; 37/453, 454

(56) References Cited

U.S. PATENT DOCUMENTS 4,893,875 * 1/1990 Lonn et al. ..... 299/113
4,938,538 7/1990 Larsson et al. ..... 299/111
5,112,165 * 5/1992 Hedlund et al. ..... 299/106
5,219,209 * 6/1993 Prizzi et al. ..... 299/111
5,503,463 * 4/1996 Ojanen ..... 299/107
5,702,160 * 12/1997 Levankovskii et al. ..... 299/113

* cited by examiner

*Primary Examiner*—David Bagnell
*Assistant Examiner*—John Kreck
(74) *Attorney, Agent, or Firm*—Burns, Doane, Swecker & Mathis, LLP

(57) ABSTRACT

A rotatable tool for breaking hard material includes an elongated tool body and a cutting cap mounted on the tool body. The cutting cap includes a generally conical front tip having a maximum first diameter (d), and a rear base portion having an outer peripheral surface defining a maximum second diameter (D). An intermediate portion extends from the tip to the base, and at least a part of the intermediate portion has a concave outer peripheral surface. A longitudinal extent (H) of the cap extends from a front end of the tip to a rear end of the outer peripheral surface of the base. A ratio of d to D is equal to or greater than 0.7. A ratio of H to D is equal to or greater than 1.0.

11 Claims, 2 Drawing Sheets

FIG. 1
(PRIOR ART)
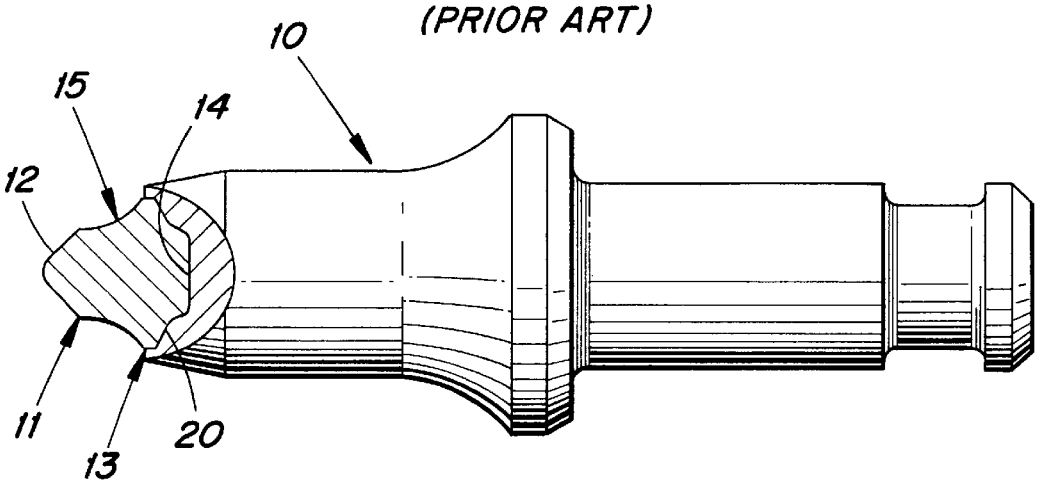
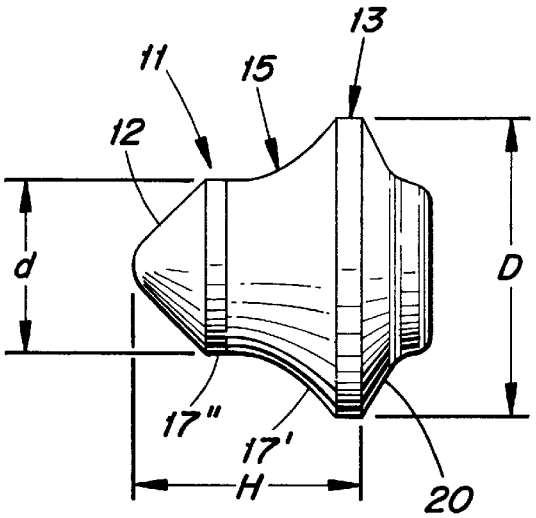
FIG. 2
(PRIOR ART)
FIG. 3
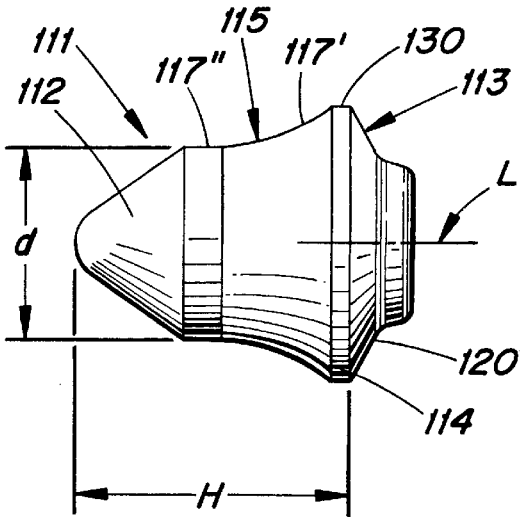

CUTTING TOOL FOR BREAKING HARD MATERIAL, AND A CUTTING CAP THEREFOR

BACKGROUND OF THE INVENTION

The invention relates to cutting tools used on mining and construction machines to break hard natural materials such as rock and minerals (e.g., coal) and also man-made materials such as concrete and asphalt.

Known in the industry is a prior art cutting tool of that type which comprises a hard alloy cap having a base mounted on a metal shank (e.g., see U.S. Pat. No. 4,938,538). The base of the hard alloy cap is shaped in such a way as to provide the tool with sufficient strength and durability for its intended operating conditions. Also known in the industry is the fact that caps have a better geometric shape than inserts, which improves the cutting efficiency of the tool by reducing the cutting forces needed to break the material. Further known is the fact that caps increase the operating life of prior art tools by better protecting the metal shank from the material being cut.

However, the geometric form of the cap is not optimal for the operating life of the tool. A prior art tool depicted in FIGS. 1 and 2 comprises a steel tool body 10 and a cap 11 of hard metal. The cap 11 has a conical tip 12, and a base 13 intended to rest against a supporting surface 14 on the tool body 10, to protect the portion of the steel tool body 10 surrounding the cutting cap 11 from such wear as would cause the cap 11 to become loose. The rear contact surface 20 of the base 13 is brazed to the supporting surface 14. The cap 11 is provided with an intermediate portion 15 located between the tip 12 and the base 13.

The intermediate portion 15 comprises a cylindrical intermediate surface portion 17", and a concave portion 17'. Due to the elongated intermediate surface portion 17" the required cutting force is maintained low even when the tip portion 12 becomes worn since the tip size remains generally the same as the tip wears down along the elongated intermediate surface portion 17". Due to this design it is also ensured that the steel in the tool body 10 surrounding the cutting insert is protected against premature abrasion; this protection being provided by the concave portion 17' and the base 13. The base 13 has a diameter D, and the intermediate surface portion 17" has a diameter d. A distance H extends from the front of the tip portion 12 to a rear end of the base 13. A ratio of H/D is less than 1.0, and a ratio of d/D is less than 0.7.

Despite the successful performance of that cap 11, room for improvement remains. Often times the cap wears down to a shape that increases the cutting forces so much that the tool becomes unusable. Larger caps can increase the life of the tool, but since the hard alloy material is usually an expensive tungsten-cobalt material, the cost of the tool also increases.

An object of the invention is to provide a cap geometry which reduces the cost of the tool by using less tungsten-cobalt material while increasing the life of the tool by maintaining lower cutting forces longer, and at the same time protecting the metal shank from the material being cut.

SUMMARY OF THE INVENTION

The invention relates to a rotatable tool for breaking hard material.

The tool comprises an elongated tool body, and a cutting cap formed of hard metal and defining a longitudinal axis.

The cutting cap includes a generally conical front tip, a rear base portion, and an intermediate portion. The tip has a maximum first diameter (d). The base portion has an outer peripheral surface defining a maximum second diameter (D), and a rearwardly facing surface bonded to a front end of the tool body. The intermediate portion extends from the tip to the base and defines an abrupt transition from the tip. At least part of the intermediate portion has a concave outer peripheral surface. A longitudinal extent (H) of the cap extends from a front end of the tip to a rear end of the outer peripheral surface of the base. The ratio of d to D is equal to or greater than 0.7. The ratio of H to D is equal to or greater than 1.0.

The invention also relates to the cutting cap per se.

BRIEF DESCRIPTION OF THE DRAWING

The objects and advantages of the invention will become apparent from the following detailed description of a preferred embodiment thereof in connection with the accompanying drawing in which like numerals designate like elements in which;

FIG. 1 is a side elevational view, partly broken away, depicting a prior art excavating tool;

FIG. 2 is a side elevational view of a prior art cutting cap used in the tool of FIG. 1;

FIG. 3 is a side elevational view of a cutting cap according to the present invention;

DETAILED DESCRIPTION OF PREFERRED EMBODIMENTS OF THE INVENTION

Figure 4:
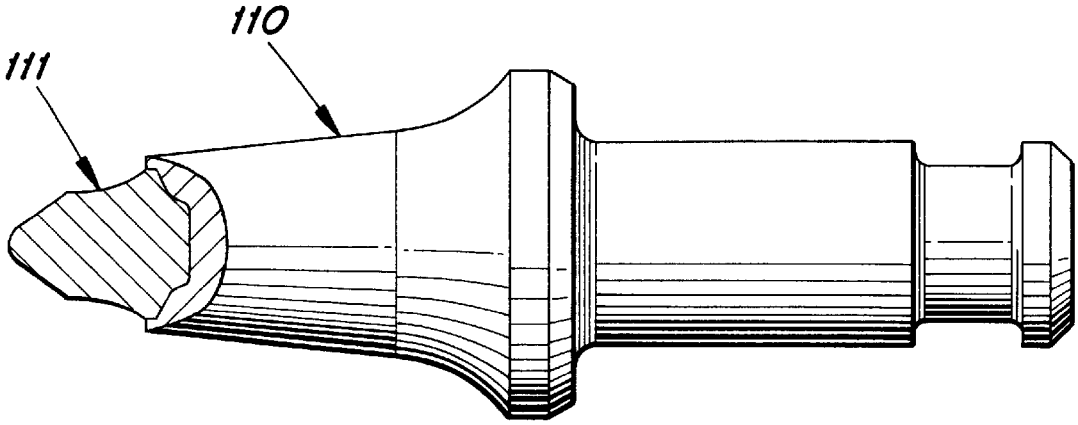
FIG. 4 is a side elevational view, partly broken away, depicting the cutting cap of FIG. 3 mounted in a tool body.

A hard alloy cap 111 for use in a steel tool body 10 defines a longitudinal axis L. The cap 111 includes a conical tip 112, and a base 113 which is intended to rest on a front supporting surface 14 of the tool body 10. The base 113 includes a cylindrical outer peripheral surface 114, and a projection forming a rearwardly facing contact surface 120 brazed to the supporting surface 14. The cutting cap 111 includes an intermediate portion 115 located between the tip 112 and the base 113. The base 113 protects the portion of the tool body 10 that surrounds the cap from excessive wear.

The intermediate portion 115 comprises a cylindrical intermediate surface 117" adjoining the tip 112, and a concave surface portion 117' extending from the intermediate surface 117" to the front end of the base 113. In FIG. 3 the following dimensions are represented:

D—maximum diameter of base 113 d—maximum diameter of tip 112

H—longitudinal extent from the front end of the tip 112 to an intersection 130 of the rearwardly facing surface 120 with the maximum diameter of the base (i.e., the effective height of the cap.) That surface 120 tapers rearwardly and is oriented coaxially with the longitudinal center axis L of the cap 111.

The following relationships are critical for the invention:

$$H/D \geqq 1.0$$

$$d/D \geqq 0.7$$

Thus, it is critical that the ratio of H/D be equal to or greater than 1.0, and that the ratio of d/D be equal to or greater than 0.7.

Prior art caps having a d/D ratio less than 0.7, and a H/D ratio less than 1.0, result in a short geometry having a small intermediate diameter d, and a wide base.

By making the d/D ratio greater than or equal to 0.7, and making the H/D ratio equal to or greater than 1.0, there results a taller geometry having a larger intermediate diameter and smaller base diameter. Those ratios make the cap more economical by reducing the cap volume, i.e., the amount of expensive hard alloy (e.g., tungsten carbide-cobalt alloy) that must be used to make the cap. The ratios also keep the tool sharper, thereby increasing tool life by maintaining lower cutting forces for a longer period.

Although the intermediate portion 115 has been depicted as including a cylindrical portion 117", that portion 117" could be deleted and replaced by an extension of the concave surface 117', which extension would be substantially parallel to the axis L at the place where it intersects the tip 112.

Figure 5:
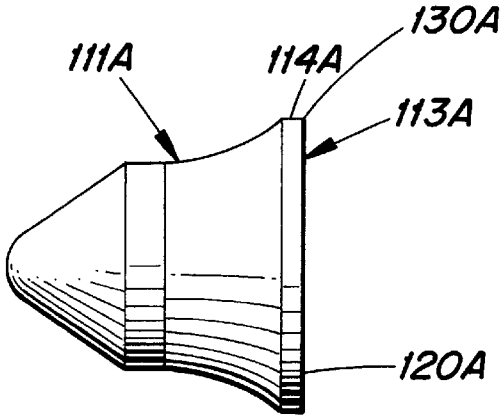
FIG. 5 is a view of a modified form of the cap depicted in FIG. 3.
Figure 6:
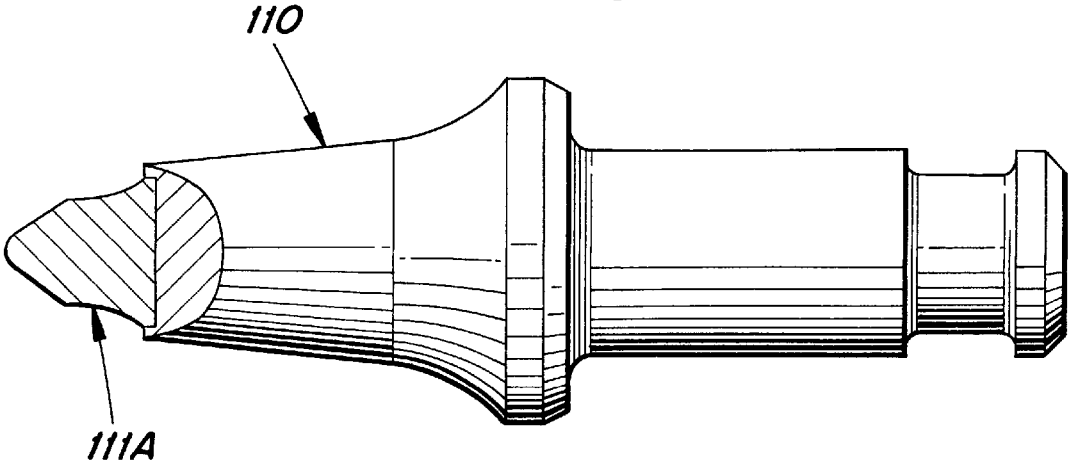
FIG. 6 is a view of the cap of FIG. 5 mounted in a tool body.

A modified form of a cap 111A is depicted in FIGS. 5 and 6. The cap 111A corresponds to the cap 111, except that the base 113A does not include a rearward projection. Thus, the surface 120A that is brazed to the tool body 110 extends perpendicularly to the axis L and intersects the rear end of the cylindrical surface 1114A of the base 113A at 130A.

Although the present invention has been described in connection with a preferred embodiment thereof, it will be appreciated by those skilled in the art that additions, deletions, modifications, and substitutions not specifically described may be made without departing from the spirit and scope of the invention as defined in appended claims.

What is claimed is:

1. A rotatable tool for breaking hard material, comprising:

an elongated tool body; and a cutting cap formed of hard metal defining a longitudinal axis and including:

a generally conical front tip having a maximum first diameter (d), a rear base portion having an outer peripheral surface defining a maximum second diameter (D), and a rearwardly facing surface bonded to a front end of the tool body, and an intermediate portion extending from the tip to the base and defining an abrupt transition from the tip, at least part of the intermediate portion having a concave outer peripheral surface, a longitudinal extent (H) of the cap extends from a front end of the tip to an intersection of the rearwardly facing surface with the maximum second diameter, wherein $d/D \geqq 0.7$ and $H/D \geqq 1.0$.

2. The tool according to claim 1 wherein the intermediate portion further includes a cylindrical portion interconnecting the tip and the concave surface.

3. The tool according to claim 1 wherein the intersection between the rearwardly facing surface and the maximum second diameter lies at a rear end of a cylindrical portion of the outer peripheral surface.

4. The tool according to claim 1 wherein the rearwardly facing surface is disposed on a projection projecting rearwardly from the maximum second diameter coaxially relative to a longitudinal center axis of the cutting cap, the rearwardly facing surface tapering rearwardly.

5. The tool according to claim 1 wherein the rearwardly facing surface is oriented perpendicular to a longitudinal center axis of the cutting cap.

6. A cutting cap adapted to be mounted on a rotatable tool body for breaking hard material, the cutting cap formed of a hard metal and defining a longitudinal axis, the cutting cap comprising:

a generally conical front tip having a maximum first diameter (d), a rear base portion having an outer peripheral surface defining a maximum second diameter (D), and a rearwardly facing surface adapted to be bonded to a front end of the tool body, and an intermediate portion extending from the tip to the base and defining an abrupt transition from the tip, at least part of the intermediate portion having a concave outer peripheral surface, a longitudinal extent (H) of the cap extends from a front end of the tip to an intersection of the rearwardly facing surface with the maximum second diameter, wherein $d/D \geqq 0.7$ and $H/D \geqq 1.0$.

7. The cutting cap according to claim 6 wherein the intermediate portion further includes a cylindrical portion interconnecting the tip and the concave surface.

8. The cutting cap according to claim 6 wherein the concave surface has a constant radius of curvature.

9. The cutting cap according to claim 6 wherein the intersection between the rearwardly facing surface and the maximum second diameter lies at a rear end of a cylindrical portion of the outer peripheral surface.

10. The cutting cap according to claim 6 wherein the rearwardly facing surface is disposed on a projection projecting rearwardly from the maximum second diameter coaxially relative to a longitudinal center axis of the cutting cap, the rearwardly facing surface tapering rearwardly.

11. The cutting cap according to claim 6 wherein the rearwardly facing surface is oriented perpendicular to a longitudinal center axis of the cutting cap.

* * * * *